US005937953A

United States Patent [19]

Melberg et al.

[11] Patent Number: 5,937,953

[45] Date of Patent: Aug. 17, 1999

[54] SOIL SAMPLING TOOL WITH UNIQUE VENT-AND-SEAL FEATURES AND RELATED METHOD

[75] Inventors: Nils K. Melberg; Lloyd E. Jacobs; David E. Turriff; Christopher A. Reitmeyer, all of Green Bay, Wis.

[73] Assignee: En Novative Technologies, Inc., Green Bay, Wis.

[21] Appl. No.: 08/898,506

[22] Filed: Jul. 22, 1997

Related U.S. Application Data

[63] Continuation-in-part of application No. 08/686,147, Jul. 24, 1996, Pat. No. 5,706,904.

[51] Int. Cl.[6] ..... F21B 49/02; G01N 1/08

[52] U.S. Cl. ..... 175/20; 73/864.44; 172/22

[58] Field of Search ..... 175/20; 73/864.44, 73/864.45; 172/22

[56] References Cited

U.S. PATENT DOCUMENTS

| | | | |
|---|---|---|---|
| 3,326,049 | 6/1967 | Eley | 73/429 |
| 3,444,938 | 5/1969 | Ballmann | 111/101 |
| 3,497,018 | 2/1970 | Shulz et al. | 175/20 X |
| 4,989,678 | 2/1991 | Thompson | 175/20 |
| 5,186,263 | 2/1993 | Kejr | 175/20 |
| 5,343,771 | 9/1994 | Turriff et al. | 73/864.44 |
| 5,517,868 | 5/1996 | Turriff et al. | 73/864.44 |

*Primary Examiner*—David J. Bagnell

*Attorney, Agent, or Firm*—Jansson, Shupe, Bridge & Munger, Ltd.

[57] ABSTRACT

A soil-sampling tool extends along a longitudinal axis and includes a barrel having a soil-penetrating distal end, and a cap for closing the end. In the improvement, the barrel has a seal surface spaced from the end and also has a tapered lead portion between the surface and the end. The lateral dimension of the lead portion is less than that of the seal surface. The cap includes an abutment face and a seal spaced therefrom. The barrel seal surface is spaced from the barrel end by a dimension not greater than that between the cap seal and its abutment face. In a highly preferred embodiment, the barrel has a stop shoulder between the barrel seal surface and the barrel end. The cap includes a lip bearing against the stop shoulder and a tapered cap face substantially contacting the barrel face of the tapered lead portion. The tool also relates to a new method.

16 Claims, 10 Drawing Sheets

SOIL SAMPLING TOOL WITH UNIQUE VENT-AND-SEAL FEATURES AND RELATED METHOD

CROSS-REFERENCE TO RELATED APPLICATION

This application is a continuation-in-part of application Ser. No. 08/686,147 filed Jul. 24, 1996, now U.S. Pat. No. 5,706,904.

FIELD OF THE INVENTION

The invention relates generally to measuring and testing and, more particularly, to devices used for soil testing.

BACKGROUND OF THE INVENTION

Soil sampling tools and devices are used for a variety of purposes, e.g., to obtain samples for soil moisture content or to learn whether and to what extent a volatile organic compound (VOC) may have permeated the soil. And soil cores are removed for other reasons unrelated to VOC analysis. Examples of soil coring and sampling tools are shown in U.S. Pat. No. 3,326,049 (Eley); U.S. Pat. No. 3,444,938 (Ballman); U.S. Pat. No. 3,497,018 (Schultz et al.); U.S. Pat. No. 4,729,437 (Zapico); U.S. Pat. No. 4,819,735 (Puckett); U.S. Pat. No. 4,888,999 (Kozak); U.S. Pat. No. 4,989,678 (Thompson); U.S. Pat. No. 5,505,098 (Turriff et al.); U.S. Pat. No. 5,522,271 (Turriff et al.) and U.S. Pat. No. 5,517,868 (Turriff et al.).

The invention relates particularly to soil sampling for assaying a VOC which may be present in a sample. It is common knowledge that tanks for storing liquid may, over time, develop a leak. If the tank is above ground, the leak is usually observed rather soon after its onset and not much damage results. On the other hand, there is an already-substantial and growing awareness that certain types of liquid storage tanks placed underground have a greater-than-normal propensity to deteriorate and leak. Such types include tanks made of steel from which protective coatings have either been eaten away or were non-existent.

And a substantial factor contributing to the risk of tank leakage is that with an underground tank, leakage is not visible. Usually, such leakage, its seriousness and appropriate remediation steps can only be determined after excavation and testing.

Undetected leaks of underground storage tanks can and do contaminate soil and potable water supplies. Because of the number of gasoline service stations and private fuel and solvent storage tanks, leakage of volatile organic compounds (VOCs) such as petroleum distillates, hydrocarbons, ketones, acetates and the like is a problem of particular concern.

Good remediation requires that personnel be able to accurately determine the nature and extent of the leak. This involves ascertaining the degree to which soil may be contaminated by a VOC. Analysis of VOC contamination of a soil sample is by placing the sample into a laboratory vial with chemicals used for such analysis.

To accurately analyze the type and degree of VOC contamination, it is important that the sample be preserved during transportation from the field site to the laboratory and during any storage of the sample prior to analysis. Good sample preservation requires that the sample be isolated from air so as to yield a sample for post-coring analysis that evidences substantially the same level and type of VOC contamination as prevailed when the sample was first cored from the earth. Good sample preservation becomes more difficult when, as is often the case, analysis occurs significantly later in time than the actual coring.

A recently-identified difficulty relating to sampling tools of the type disclosed in the Turriff et al. patents (i.e., tools having caps for VOC entrapment) is that air can become trapped between the cap and the barrel. Such trapped air may prevent a good seal and has the potential to permit VOC to volatilize to some degree before the soil sample can be analyzed.

The corer disclosed in the Schultz et al. seemingly evidences the same difficulty. And in any event, coring tube closure is by sliding the tube downwardly into a sheath mounted on a shelf of a submersible vessel, a wholly-impractical arrangement for above-ground, field site sampling.

The Schultz et al. corer has another feature which presents a subtle but very-real disadvantage in VOC sampling applications. That corer has a small but discernible "dead volume" trapped at the stopper. Air dead volume in a VOC sampling tool is disadvantageous because such trapped air provides a medium into which VOC may migrate and impair the integrity of the sample.

Still another disadvantage of the Schultz et al. corer in VOC applications is that such corer is for use with saturated soil, i.e., soil at the bottom of a lake. Typical VOC sampling tools are used for soil sampling in the vadose zone, i.e., the zone of soil between earth surface and the water table. Typically (although not absolutely), the water content of such soil in the vadose zone will be in the range of 20% or below.

Yet another disadvantage of sampling tools such as that disclosed in the Turriff et al. '771 patent is that the cover is secured to the barrel only by friction. A cover which inadvertently falls from the barrel during transportation and/or storage is likely to make the sample unreliable.

An improved sampling tool and method which address disadvantages inherent in prior art sampling tools would be a significant advance in this technical field.

OBJECTS OF THE INVENTION

It is an object of the invention to provide an improved soil sampling tool overcoming some of the problems and shortcomings of the prior art.

Another object of the invention is to provide an improved soil sampling tool which is particularly well adapted for taking samples of soil contaminated with VOC.

Still another object of the invention is to provide an improved soil sampling tool which permits expulsion of otherwise-trapped air during coring.

Another object of the invention is to provide an improved soil sampling tool which permits expulsion of otherwise-trapped air during post-coring tool closure.

Yet another object of the invention is to provide an improved soil sampling tool which is substantially free of entrapped air when fully closed.

Another object of the invention is to provide an improved soil sampling tool which preserves the integrity of the sample (and, particularly, of the VOC vapor in the sample) being collected.

Another object of the invention is to provide an improved soil sampling tool in which the cap and barrel are well secured to one another.

Yet another object of the invention is to provide an improved soil sampling tool which is specifically for use in the vadose zone.

Still another object of the invention is to provide an improved method for collecting a soil sample which preserves the integrity of the sample. How these and other objects are accomplished will become apparent from the following descriptions and from the drawings.

SUMMARY OF THE INVENTION

The invention involves a hand-held, hand-manipulated sampling tool primarily used to assay VOCs in soil. The tool is specifically configured for sampling in the vadose zone. The new tool may also be used for assaying semi-volatile organic compounds, e.g., diesel fuel, or for assaying other contaminants in soil.

The tool includes a barrel having a soil-penetrating distal end, and a cap for closing the end. In the improvement, the barrel has a smooth seal surface spaced from the barrel end. Such surface has a first lateral dimension, i.e., a diameter (in the case of a generally cylindrical barrel) measured perpendicularly to the long axis. The barrel has a lead portion between the surface and the end and such portion has a second lateral dimension less than the first lateral dimension. The cap includes an abutment face and a seal spaced from the abutment face by a longitudinal dimension which is also referred to herein as a "first" longitudinal dimension. The barrel seal surface is spaced from the end by a distance not greater than the longitudinal dimension.

In a more specific embodiment, the lead portion includes a tapered barrel face extending axially away from the end and the cap includes a tapered cap face extending axially away from the abutment face. The barrel face and the cap face engage one another when the abutment face is substantially against the barrel end. Barrel/cap shape conformity and "fit" are highly desirable to help prevent air-occupied voids.

And air venting during tool capping is also highly preferred. To that end, the barrel includes a mid-surface having a lateral surface dimension and the barrel seal surface is between the mid-surface and the end. The cap includes a relief surface having a lateral relief dimension greater than the lateral surface dimension, thereby defining an air vent passage between the mid-surface and the relief surface.

It is also highly preferred that the cap be well secured to the barrel so that the integrity of the "captured" sample is retained. To that end, the barrel includes an exterior deformity spaced from the end by a second longitudinal dimension. The cap includes a locking member having an interior deformity spaced from the abutment face by the second longitudinal dimension.

In a specific embodiment, the exterior deformity on the barrel includes a radially outwardly extending ridge. And the interior deformity on the cap locking member includes a groove. Of course, the barrel exterior deformity could be a groove or indentation and the cap interior deformity could be a projection.

In another aspect of the invention, the barrel has a seal surface spaced from the barrel distal end, a stop shoulder between the seal surface and the end and a tapered barrel face extending away from the end. The cap includes a lip against the stop shoulder, a seal against the seal surface and a tapered cap face substantially contacting the barrel face. To put it in other terms, the lip and shoulder coact to limit the travel of the cap onto the barrel. Such lip and shoulder help assure proper axial positioning of the cap and barrel to one another so that the seal is against the seal surface and the cap and barrel faces are positioned to substantially exclude any air voids.

Other aspects of the invention address alternate ways to effect a good seal between the cap and barrel and alternate ways to vent air from the barrel as the sample is being taken. In an alternate embodiment, a seal is interposed between the abutment face and the distal end. The barrel includes a plunger head in the barrel cavity and a releasable vent valve opening into the cavity. The plunger head is between the vent valve and the distal end, at least while the head is moving toward the cavity terminus.

In a more specific embodiment, the seal is a septum having a diameter substantially equal to the diameter of the barrel distal end. A suitable septum is a disc-shaped pad made of Teflon® or Viton®. In another embodiment, the seal is a flexible sheet of, e.g., Teflon® or Viton®, between the cap and the barrel.

An exemplary embodiment of a vent valve includes a screw threaded into the barrel. The screw is loosened while taking a sample and thereafter tightened to seal and prevent migration of air into the cavity. Other configurations of vent valves, e.g., a "duck bill" valve, are also suitable.

A convenient accessory includes a T-shaped elongate insertion handle affixed to the barrel or which can be affixed to the barrel. The barrel has a pair of L-shaped (or reverse L-shaped) channels formed in it and the handle includes an attachment portion having a pair of pins. Each pin extends into a respective channel. The handle also includes a biased latch mechanism positioned with respect to the pins so that the mechanism extends into a retention slot when the pins are in those "legs" of the channels which are horizontal when the tool is vertical.

Another aspect of the invention involves a method for collecting a soil sample containing a VOC. The method includes providing a sampling tool including (a) a barrel having a barrel distal end, (b) a soil-receiving cavity in the barrel, and (c) a cap for closing the end. The distal end is pushed into soil so that the cavity is filled with the sample. The cap is then urged over the barrel distal end and toward a sealing position, thereby expelling air through a vent structure. Closure is by positioning the cap at the sealing position, thereby occluding the vent structure.

In more specific aspects of the method, the filling step includes (and is concluded by) closing the air passage adjacent to the cavity terminus. And the positioning step includes placing the O-ring seal against the seal surface or placing the septum pad against the barrel distal end which, in one embodiment, forms the seal surface.

Other features of the invention are set forth in the following detailed description and in the drawings.

DETAILED DESCRIPTION OF PREFERRED EMBODIMENTS

Figure 1:
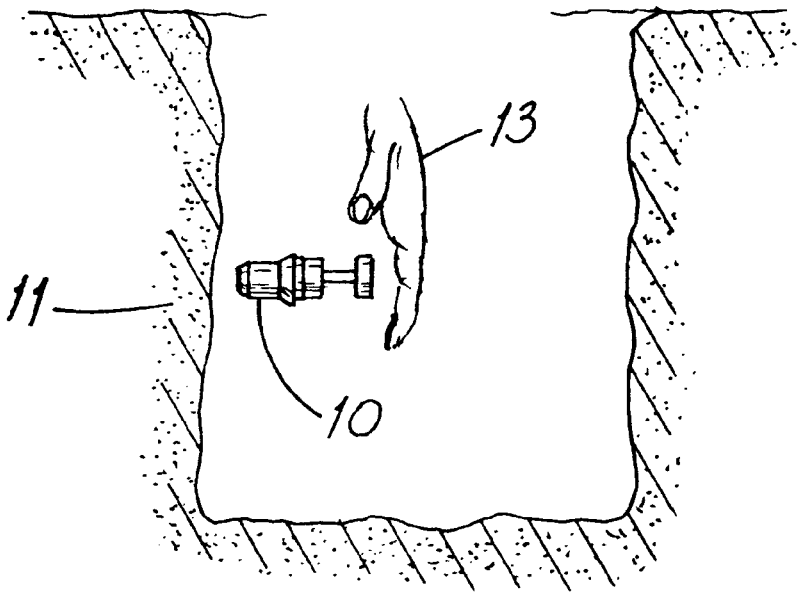
FIG. 1 is a sectional elevation view showing how the new tool is hand-urged into possibly-contaminated soil.
Figure 2:
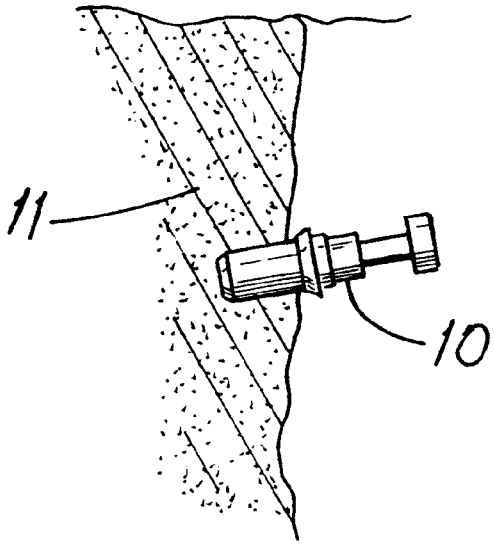
FIG. 2 is a sectional elevation view showing the tool in the soil.

Referring first to FIG. 1, the new soil sampling tool 10 is of the type which is urged into possibly-contaminated soil 11 by using one's hand 13. That is to say, the tool 10 is not hammered into the soil 11 nor is a pre-drilled hole formed in the soil 11 to accept the tool 10. The matter of soil sampling generally is discussed in U.S. Pat. No. 5,517,868 (Turriff et al.) which is incorporated herein by reference.

Referring next to FIGS. 3 through 11, the main components of the new tool 10 include a barrel 15, a plunger 17, a handle 19 and a cap 21 for closing the knife-like distal end 23 of the barrel 15 when a sample 25 is contained therein. Such components are discussed below in that order.

The barrel 15 includes a generally-cylindrical but slightly-tapered interior barrel wall 27 around a sampling cavity 29 in which a soil sample 25 is received. The barrel 15 has an annular, substantially flat surface which is spaced from the distal cutting end 23 and which forms an interior cavity terminus 31. Extending along the barrel proximal end 33 is an axial passage 35 to accommodate the stem 37 of the plunger 17 with slight clearance. Such passage 35 is concentric with the long axis 39 of the barrel 15.

Referring particularly to FIGS. 3, 4, 5, 8 and 12, the new tool 10 includes a locking mechanism 41 which sets the volume of a contained soil sample 25 equal to a reference volume. Such mechanism 41 also provides a visual indication that such contained sample 25 has the requisite reference volume.

Particularly considering FIGS. 3, 4, 5 and 12, the face 43 of the proximal end 33 includes a first locking member 45 embodied as a cam-like ledge 45*a*. The ledge 45*a* is cam-like in that it gently slopes. When considered from point 47 to point 49, the ledge 45*a* slopes away from the distal end 23. Similarly, the ledge 45*b* gently slopes away from the distal end 23 when considered from point 51 to point 53. As will become more apparent from the description below, such sloping ledge 45*a* or 45*b* urges the plunger head 55 more snugly into the barrel cavity 29 when the plunger 17 is rotated. While only a single ledge 45*a*, 45*b* would suffice, a highly preferred locking member 45 incorporates both ledges 45*a*, 45*b* and such ledges 45*a*, 45*b* are spaced about 180° apart on the face 43.

Figure 3:
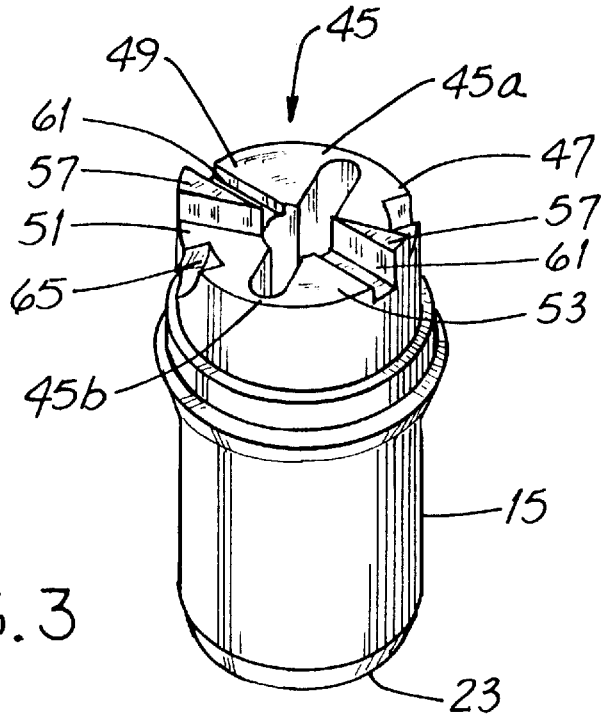
FIG. 3 is a perspective view of a component of the new tool, i.e., the barrel.
Figure 12:
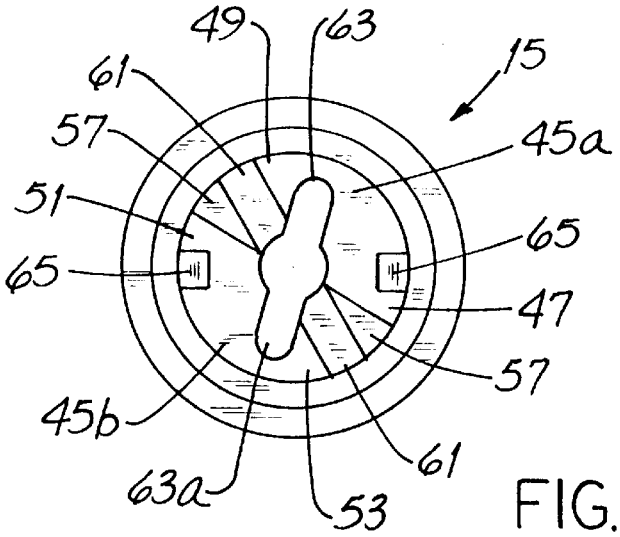
FIG. 12 is a top plan view of the tool barrel shown in FIGS. 3, 4 and 5. The view is taken along the viewing axis VA12 of FIG. 5.

At the ledge points 47, 51 nearest the barrel distal end 23, i.e., farthest from the viewer of FIG. 12, each ledge 45*a*, 45*b* is bounded by an upstanding stop 57 which is somewhat wedge-shaped in FIGS. 3 and 12. Each stop 57 extends away from the distal end 23, i.e., toward the viewer of FIG. 12. As further described below, the stops 57 prevent the plunger stem 37 and its arms 59 from being rotated in an improper direction. In the specific embodiment, the plunger stem 37 and its arms 59 may be rotated counterclockwise in the view of FIG. 12 and are prevented from rotating clockwise by the stops 57.

At the ledge points 49, 53 most distant from the barrel end 23, each ledge is bounded by a flat surface 61 formed between the point 49, 53 and the stop 57 nearest such point 49, 53. As is also described below, the arms 59 of the plunger stem 37 engage respective surfaces 61 when the plunger 17 is rotated counterclockwise (as viewed in FIG. 12) to its "locked" position. Such surfaces 61 are not required to set the cavity volume-related dimension described below but the surfaces 61 are a distinct convenience when handling a sample 25 in the barrel 15.

It is desirable to retain the plunger 17 and the barrel 15 in a particular rotational relationship to one another as a soil sample 25 is being taken. To that end, the barrel proximal end 33 also includes at least one and preferably two deformations 63. Each such deformation 63 is otherwise referred to in this specification as a "first deformation." In a specific embodiment, each first deformation 63 is a groove 63*a* formed along the stem passage 35 and circumferentially spaced about 180° from the other groove 63*a*.

Referring now to FIGS. 5, 8, 9 and 12, for easy handle attachment, the barrel proximal end 33 includes a pair of channels 65, each of which extends from the proximal end 33 toward the distal end 23 and then angularly in a circumferential direction. In a specific embodiment, each channel 65 is L-shaped or reverse L-shaped.

A convenient handle 19 is T-shaped and has a gripping portion 67 and a barrel attachment portion 69 perpendicular thereto. Near its distal end 71, the attachment portion 69 interior has a pair of pins 73 which are diametrically opposed and which extend from such portion 69 toward the portion long axis 75. The handle 19 and barrel 15 are attached to one another by sliding the pins 73 into the channels 65 and during final travel, twisting the barrel 15 and handle 19 relative to one another to couple them together.

Figure 6:
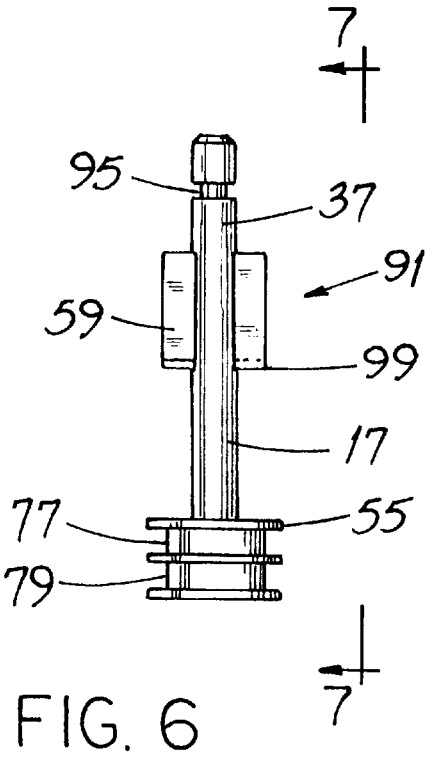
FIG. 6 is an elevation view of another component of the tool, i.e., the stem. The stem head O-rings are omitted.
Figure 7:
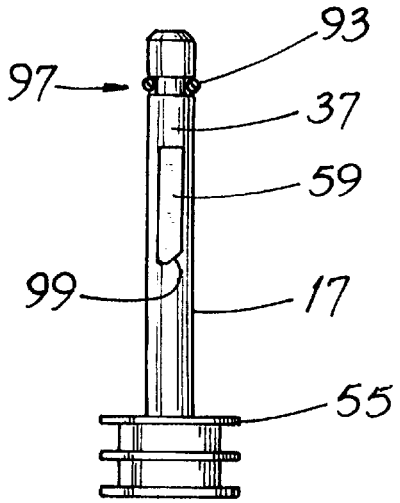
FIG. 7 is an elevation view of the stem of FIG. 6 taken along the viewing plane 7—7 thereof.
Figure 8:
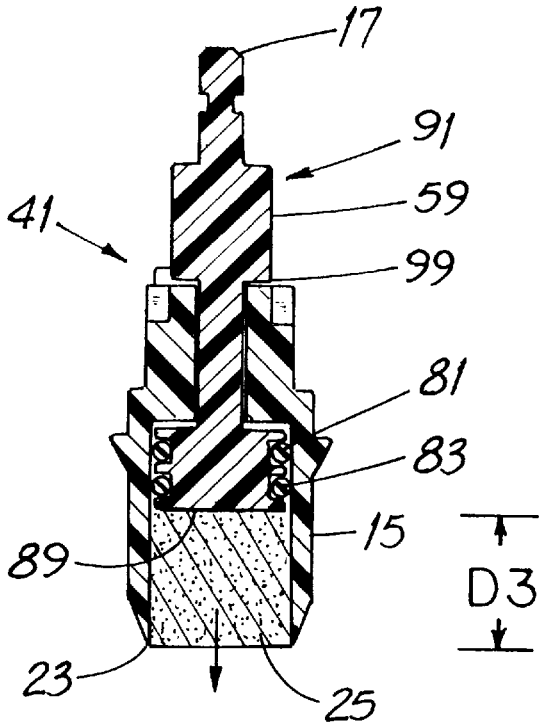
FIG. 8 is a cross-sectional elevation view of the barrel and stem assembled to one another. Such view is taken along a viewing plane coincident with the barrel long axis.
Figure 11:
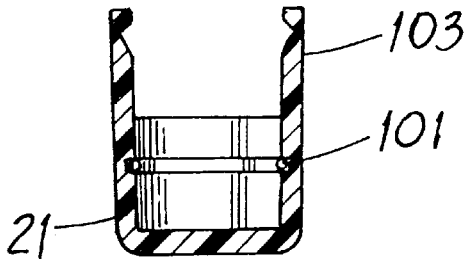
FIG. 11 is a cross-sectional elevation view of the cap of FIG. 10 taken along the viewing plane 11—11 thereof.
Figure 10:
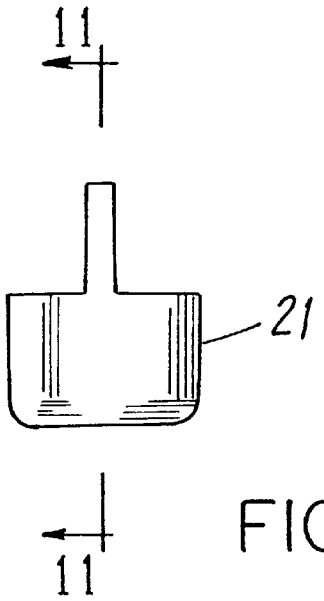
FIG. 10 is a side elevation view of still another component of the tool, i.e., the cap.
Figure 9:
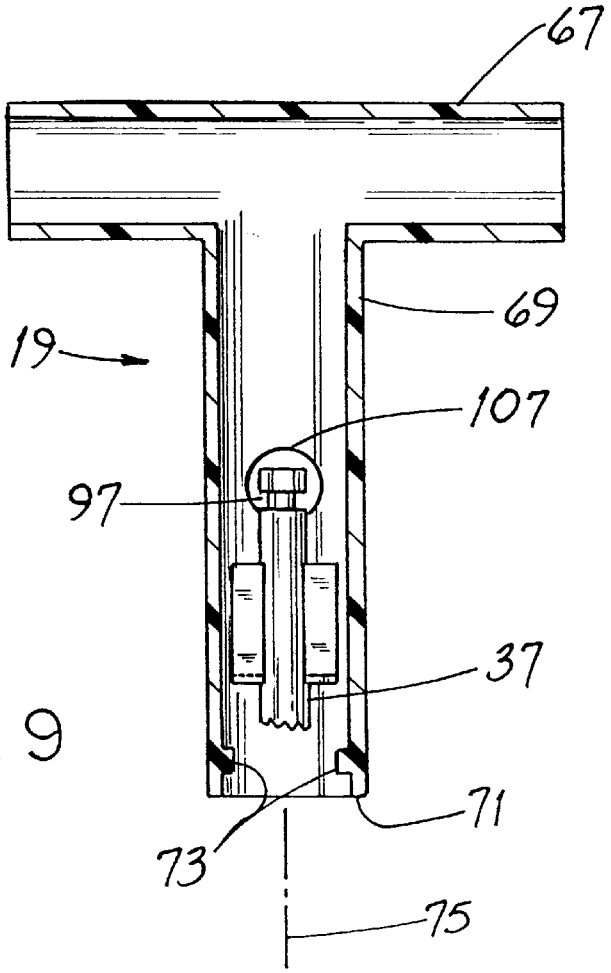
FIG. 9 is a cross-sectional elevation view of yet another component of the tool, i.e., the handle, shown in conjunction with a portion of the stem. Parts are broken away.

The tool plunger 17 will now be described. Referring next to FIGS. 6, 7 and 8, the plunger 17 includes a generally-cylindrical head 55 and a rod-like stem 37 extending axially from such head 55. When the plunger 17 is in the barrel 15, the head 55 and stem 37 are concentric with the barrel long axis 39.

Figure 13:
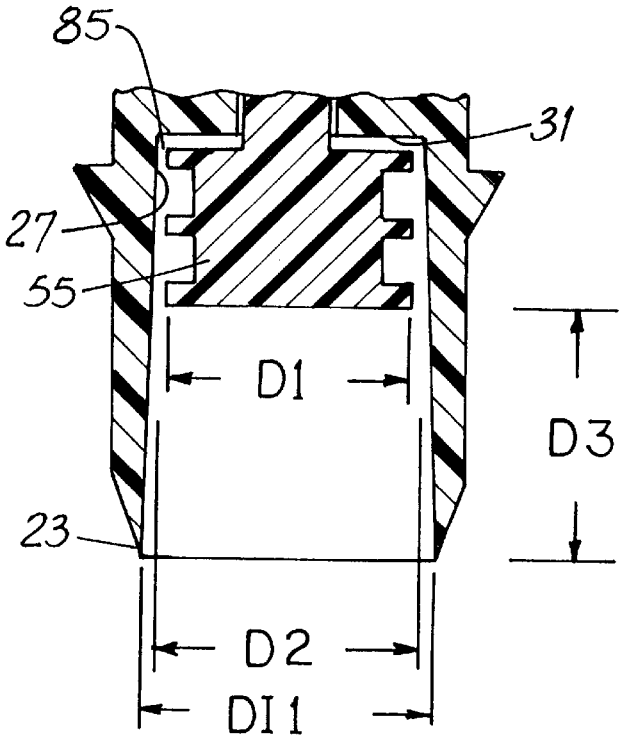
FIG. 13 is another cross-sectional elevation view of the barrel and stem assembled to one another. Parts are broken away.

The head 55 has a pair of axially-spaced-apart circumferential grooves 77 and 79, each of which has a respective O-ring seal 81, 83 retained therein. As shown in FIG. 13, the maximum diameter D1 of the head 55 per se (disregarding the O-rings 81,83) and the minimum diameter D2 of the barrel cavity 29 (such cavity 29 is slightly tapered) are cooperatively selected to define an annular space 85 between the head 55 and the barrel wall 27. (Viewed more broadly for cavities 29 and heads 55 which may be other than circular, the head 55 has a somewhat smaller cross-sectional area than that of the cavity 29 so that the head 55 and the wall 27 define a space between them.)

Figure 4:
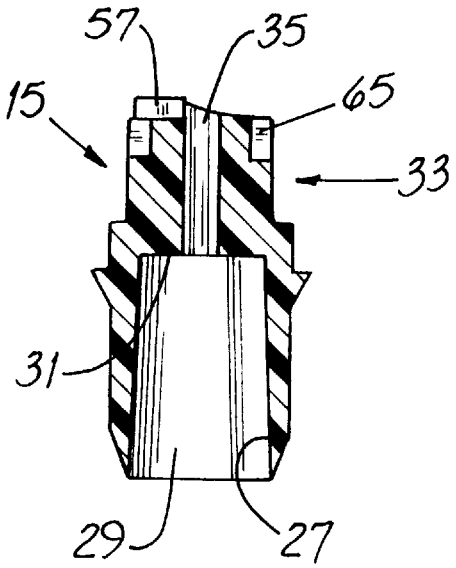
FIG. 4 is a cross-sectional elevation view of the barrel of FIG. 3. Such view is taken along a viewing plane coincident with the barrel long axis.

Considering FIGS. 4, 8 and 13, the space 85 between the head 55 and the barrel wall 27 is closed by the O-rings 81, 83 when the plunger head 55 is closely adjacent to the barrel terminus 31. And because the barrel cavity 29 is slightly outwardly tapered in an axially downward direction, there is very slight clearance 87 between the O-rings 81, 83 and the barrel wall 27 until just before the head 55 "seats" at or near the terminus 31—note FIG. 14. The result is that there is no resistance to inserting the barrel 15 into soil that arises from head/barrel friction. An exemplary barrel taper is about 1° included angle.

As shown in FIG. 8, the plunger 17 includes a soil-contact surface 89 spaced from the distal end 23 by a dimension D3 when the barrel cavity 29 is filled with a soil sample 25 having a volume V. The role played by such surface 89 in obtaining a sample 25 of a particular volume and presumed weight will become apparent.

Referring next to FIGS. 6, 7 and 8, the stem 37 has at least one laterally-extending deformation 91 and, preferably, has a pair of such deformations 91. (Each such deformation 91 is also referred to as a "second deformation.") In a specific embodiment, each deformation 91 is embodied as a paddle-like arm 59 and such arms 59 are spaced about 180° apart on the stem 37. The stem is fitted with a small O-ring 93 in a groove 95 to help prevent the plunger 17 from falling out of the barrel 15. Such O-ring 93 also serves as a volume marker 97 as described below.

Each arm 59 has a bevelled surface 99 along one lower edge. Such surfaces 99 make it easier for the arms 59 to engage and travel along their respective ledges 45*a*, 45*b* when the stem 37 is rotated as described below.

The first deformations 63 (grooves 63*a*) on the one hand and the second deformations 91 (e.g., arms 59) on the other are conformably shaped to one another so that the stem 37 may freely move axially in the barrel 15 but yet is prevented from substantial rotational movement so long as the deformations 63 and 91 engage one another. (Clearly, such deformations 63 and 91 need not be grooves 63*a* and arms 59, respectively. Other geometric shapes and shape positions are possible. As to the latter, a deformation embodied as an arm may project from the stem passage 35 into, say, a groove along the stem 37.)

Referring to FIG. 8, it is apparent that the distance D3 between the soil-contact surface 89 and the end 23 governs the volume V of a soil sample 25 that can be contained in the cavity 29. From FIG. 8, it is also apparent that when the surfaces 99 of the arms 59 are in axial registry with the ledges 45*a*, 45*b*, the soil-contact surface 89 is at some known dimension D3 from the end 23. Such dimension D3 is referred to as a reference dimension.

The locking mechanism 41 indicates in two ways that the dimension D3 is equal to a reference dimension and that the volume V of a barrel-contained soil sample 25 is established to be equal to some predetermined reference volume. One way is visually in that the surfaces 99 of the arms 59, are axially aligned with the ledges 45*a*, 45*b*. Another is tactiley; the stem 37 cannot be rotated to urge the arms 59 along their respective ledges 45*a*, 45*b* unless the soil-contact surface 89 is at some known dimension from the end 23. Recognizing that when preparing to take a soil sample 25, the recommended starting place for the plunger head 55 is at the barrel distal end 23 (as in FIG. 14), the tool user is assured that the volume V of the soil sample 25 that has pushed into the cavity 29 is that volume which yields a sample weight on the order of 5 grams, 25 grams or other appropriate weight. (One of the states of the United States is considering specifying a sample weight of 10 grams, for example.)

As noted above, the locking mechanism 41 coacts between the proximal end 33 and the stem 37. Yet another benefit of such mechanism 41 is that when locked, it prevents movement of the stem 37 toward the distal end 23.

It is also to be noted that unlike the devices shown in the Puckett and Zapico patents mentioned above, the head of the new tool 10 is free of any mechanism for adjusting the compression of the sealing ring 81 or 83. Assuming that the head 55 and cavity 29 are properly dimensioned and that properly sized O-rings 81, 83 are on the head 55, the absence of a compression-adjusting mechanism is an advantage. The user can be sure that at least one O-ring 81 fits against the barrel wall 27 with sufficient snugness to retain VOC vapors (e.g., the vapor of evaporating gasoline in the soil sample 25) while yet permitting the force of tool insertion to cause the soil sample 25 to urge the head 55 substantially to the terminus 31.

Figure 15:
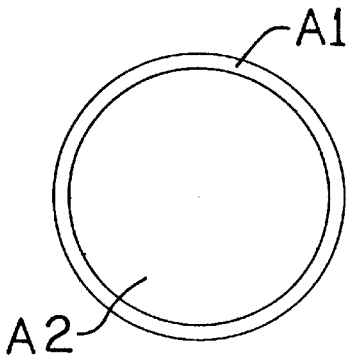
FIG. 15 is a representation of area relationships. Such representation is taken along viewing axis VA15 of FIG. 13.

Referring next to FIGS. 13 and 15, in yet another aspect of the invention, the barrel distal end 23 defines a first area A1 and, in a more specific embodiment, has a first diameter DI1. The cavity terminus 31 defines a second area A2 smaller than the first area A1 and, more specifically, has a second diameter D2 less than the first diameter DI1. So configured, the cavity 29 is slightly tapered and has a progressively-smaller cross-sectional area when viewed from the distal end 23 to the terminus 31.

Figure 14:
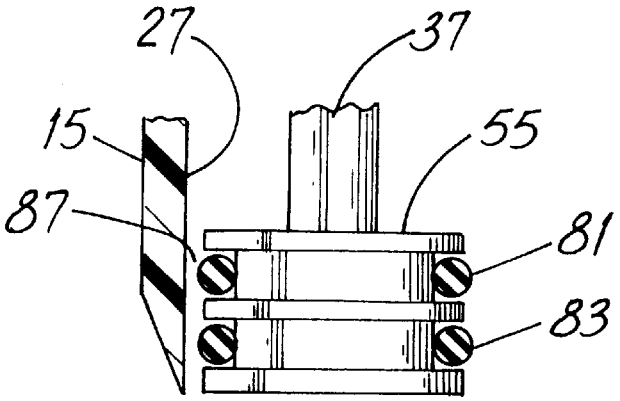
FIG. 14 is an elevation view showing a portion of the barrel in cross-section and the stem head in full representation. Parts are broken away.

In the highly preferred embodiment having two sealing rings 81, 83 shown in FIGS. 8 and 14, one of the rings, ring 83, is redundant for containing vapor of a VOC in the barrel 15. And that ring 83 closest to the barrel distal end 23 acts as a secondary seal which helps prevent dirt from working its way under the other ring 81 and impairing the integrity of VOC vapor retention.

In use, the plunger 17 is positioned in the barrel 15 so that the soil-contact surface 89 is about in registry with the end 23. The handle 19 is thereupon attached and the barrel distal end 23 urged into the soil 11 from which a sample 25 is desired to be taken. When the user believes the cavity 29 is filled to the prescribed volume, the tool 10 is withdrawn.

Thereupon, the user may remove the handle 19 and visually inspect the tool 10 to see whether the surfaces 99 of the arms 59 are axially aligned with the ledges 45*a*, 45*b*. If they are, the cavity 29 contains the requisite volume. (If the cavity 29 does not contain the requisite volume, the tool 10 is urged more forcefully into the soil 11.)

In the alternative (or in addition), the user attempts to rotate the stem 37 and barrel 15 with respect to one another. If rotation can be accomplished without further drawing the stem head 55 up into the barrel 15, the cavity 29 contains the requisite volume. In the latter instance, the stem 37 is rotated until the arms 59 engage their respective locking surfaces 61, thereby securing the stem 37. Noting FIGS. 5, 8, 10 and 11, the cap 21 with its sealing O-ring 101 is urged over the distal end 23 until the cap retention arms 103 engage the barrel surface distortion, e.g., a circumferential ridge 105 around the barrel 15. The possibly-VOC-contaminated soil sample 25 is thereby sealed in the barrel 15 and can be taken to a laboratory for analysis.

Referring again to FIGS. 7 and 9, the handle 19 of the tool 10 optionally includes a sighting aperture 107 in the handle attachment portion 69. The plunger stem 37 optionally includes a volume marker 97 thereon and in a specific embodiment, the O-ring 93 serves as such marker 97. That is, the O-ring groove 95 and the aperture 107 are cooperatively, axially positioned so that the aperture 107 and the marker 97 are aligned with one another when the plunger head 55 is against or closely adjacent to the barrel terminus 31. That positional relationship occurs when the barrel 15 is filled with a soil sample 25 having a volume V substantially equal to a reference volume, e.g., a volume characteristic of a soil sample 25 weighing about 5 grams. (It is apparent from the foregoing that when the aperture 107 and marker 97 are used, one need not remove the handle 19 from the barrel 15.)

Figure 16:
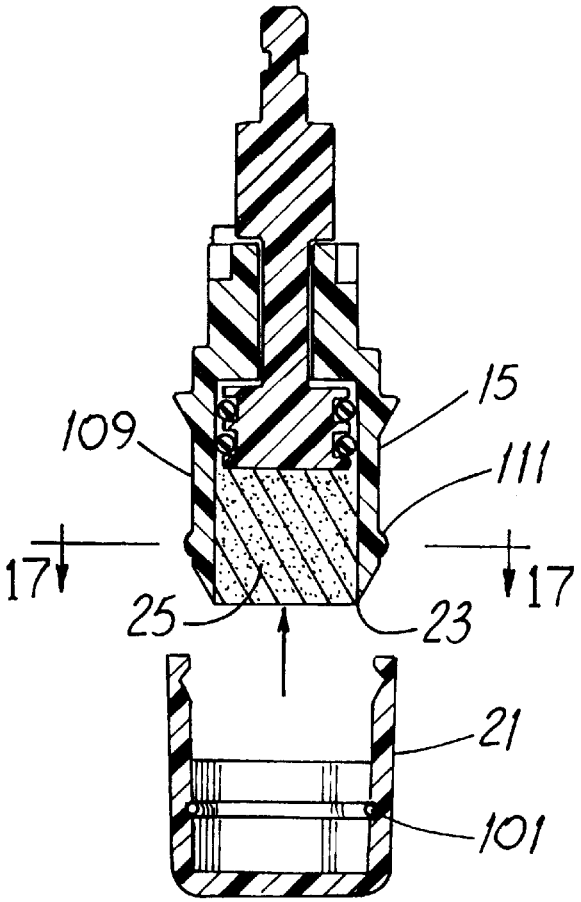
FIG. 16 is a cross-sectional elevation view of the barrel and stem assembled to one another, the barrel containing a soil sample and the closure cap positioned for sealing placement on the barrel.
Figure 17:
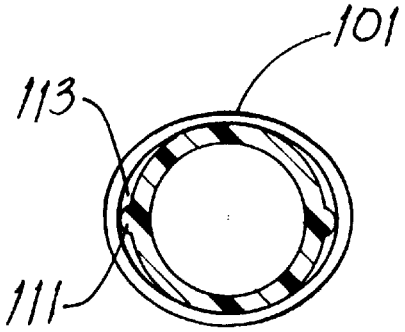
FIG. 17 is a simplified view taken along viewing plane 17—17 of FIG. 16 and showing how a barrel rib compresses the cap O-ring, thereby creating an air vent.

Referring now to FIGS. 16 and 17, another desirable feature of the tool 10 helps assure that when capping the tool barrel 15, no air will be trapped between the barrel distal end 23 (and between the soil sample 25 in the barrel 15) and the cap 21 fitted on such distal end 23. To help prevent air entrapment, the barrel outer surface 109 has at least one axially-oriented rib 111 thereon and preferably has plural ribs 111. As the cap 21 is mounted on the barrel distal end 23, the rib 111 compresses the sealing ring 101 and forms a small opening 113 between such ring 101 and such surface 109. Air between the cap 21 and the soil sample 25 is vented through such opening 113 as the cap 21 is being mounted.

Figure 18:
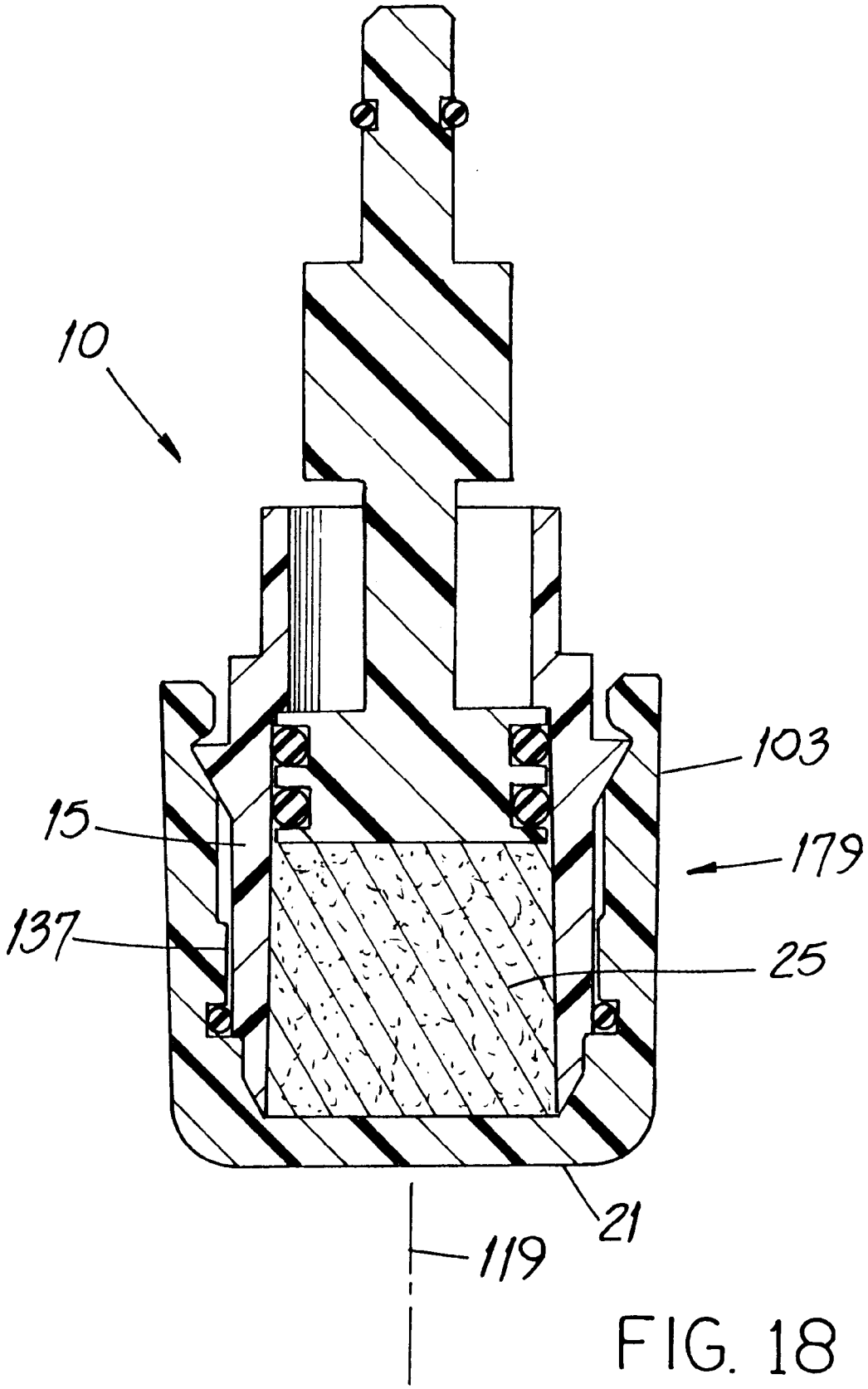
FIG. 18 is a cross-sectional elevation view of another embodiment of the new sampling tool shown with the cap closing the barrel.
Figure 19:
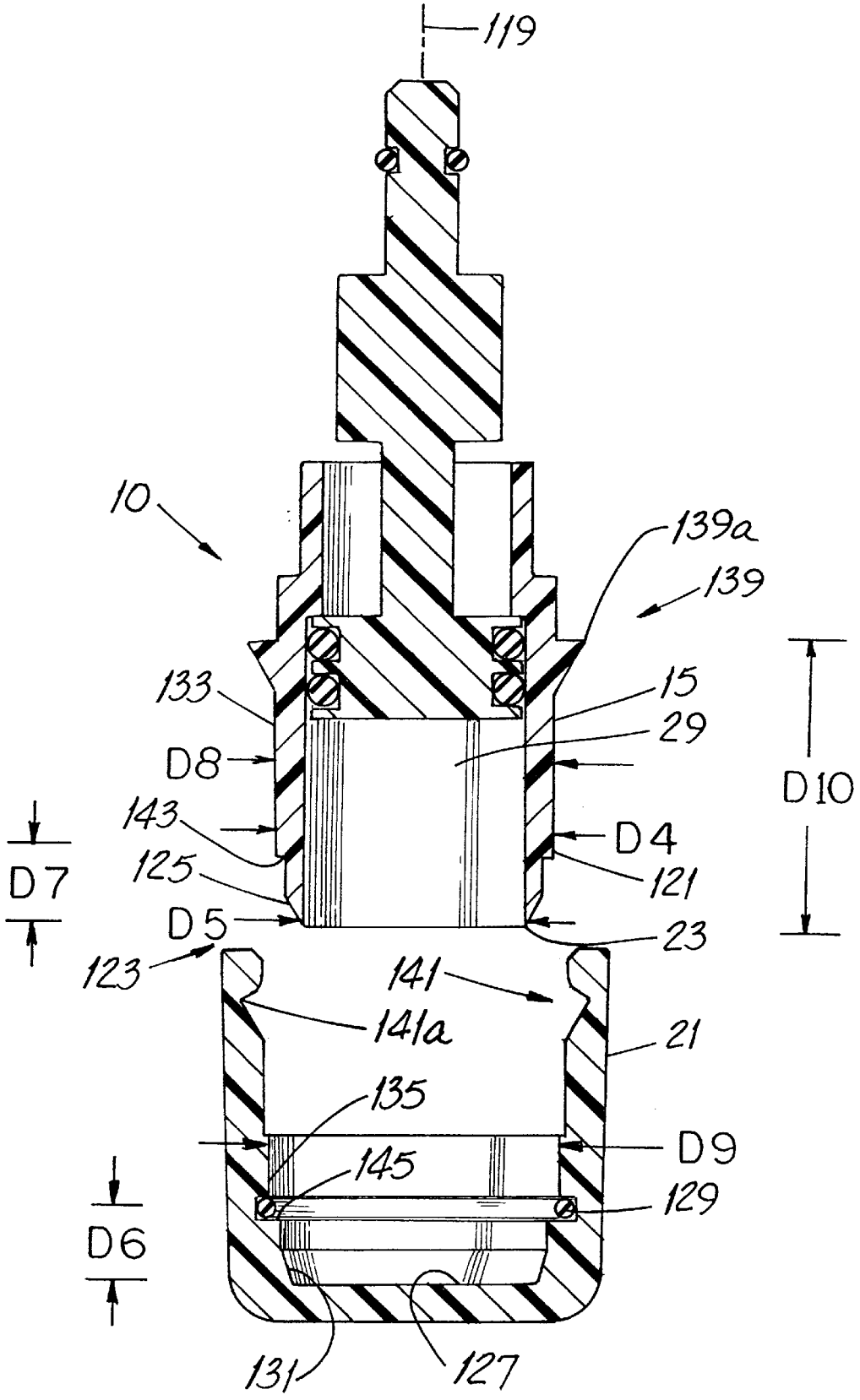
FIG. 19 is a cross-sectional elevation view of the tool of FIG. 18 shown with the cap spaced from the barrel.

Referring next to FIGS. 18 and 19, another embodiment of the tool 10 extends along the axis 119 and includes a barrel 15 and a cap 21 for closing the distal end 23 of the barrel 15. The barrel 15 has a smooth seal surface 121 (a round surface in the case of a cylindrical barrel 15) and such surface 121 is axially spaced from the barrel end 23. The surface 121 has a first lateral dimension D4, i.e., a diameter, measured perpendicularly to the axis 119.

The barrel 15 also has a tapered, reduced-diameter lead portion 123 between the surface 121 and the end 23 and having a barrel face 125. At any one of several places, such face 125 has a second lateral dimension D5 (measured perpendicularly to the axis 119) which is less than the first lateral dimension D4. The cap 21 includes a circular, generally flat abutment face 127 and a seal 129, e.g., an O-ring seal, spaced from the abutment face 127 by a first longitudinal dimension D6. The barrel seal surface 121 is spaced from the end 23 by a distance D7 not greater than such first longitudinal dimension D6.

The barrel face 125 extends axially away from the end 23 (upwardly from the end in the view of FIG. 19) and the cap 21 includes a tapered cap face 131 extending axially away from the abutment face 127. The barrel face 125 and the cap face 131 are conformably shaped and engage one another when the abutment face 127 is substantially against the barrel end 23. Any air-occupied void is thereby substantially prevented and, thus, migration of air from such a void into the cavity 29 and a soil sample 25 in the cavity 29 is also prevented.

Venting of air, otherwise trapped between the faces 127, 131 during tool capping, is also highly preferred. To that end, the barrel 15 includes a mid-surface 133 having a lateral surface dimension D8 and the barrel seal surface 121 is between the mid-surface 133 and the end 23. The cap 21 includes a relief surface 135 having a lateral relief dimension D9 greater than the lateral surface dimension D4. The cap 21 and barrel 15 thereby form a vent structure having an annular air vent passage 137 between the mid-surface 133 and the relief surface 135.

It is also highly preferred that the cap 21 be well secured to the barrel 15 so that the integrity of the "captured" sample 25 is retained even though the tool 10 is subjected to handling as it is transported to a laboratory. To that end, the barrel 15 includes an exterior deformity 139 axially spaced from the end 23 by a second longitudinal dimension D10. The cap 21 includes a locking member, e.g., one or two arms 103, having an interior deformity 141 spaced from the abutment face 127 by the second longitudinal dimension D10. Most preferably, the exterior deformity 139 on the barrel 15 includes a radially outwardly extending ridge 139*a* and the interior deformity 141 on each of the cap arms 103 includes a groove 141*a*.

In another aspect of the invention, a ledge-like, annular stop shoulder 143 is between the seal surface 121 and the end 23. The cap 21 includes an annular lip 145 and when the cap 21 and barrel 15 are properly seated to one another, the lip 145 is against the stop shoulder 143, the seal 129 is against the seal surface 121 and the faces 125, 131 substantially contact one another.

Figure 20:
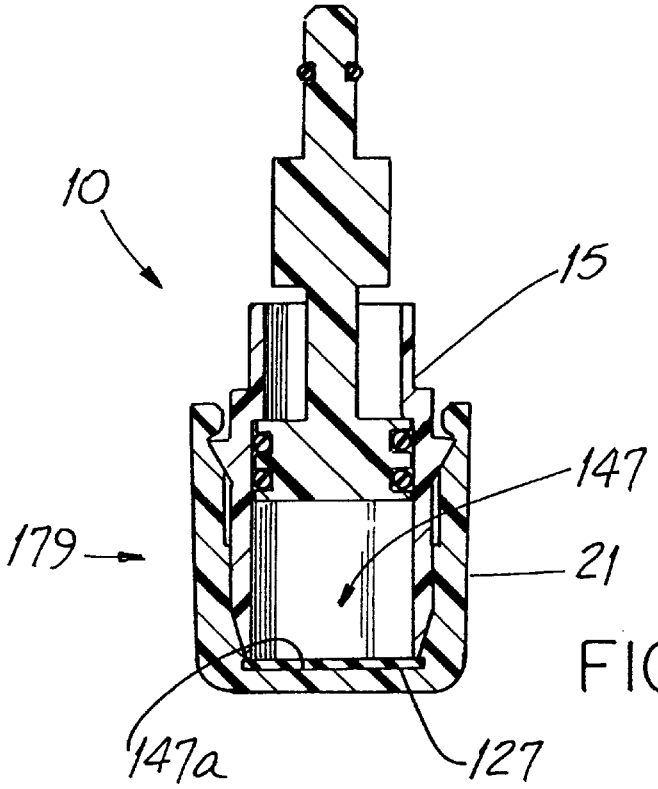
FIG. 20 is a cross-sectional elevation view of yet another embodiment of the new sampling tool showing an alternate sealing arrangement.
Figure 21:
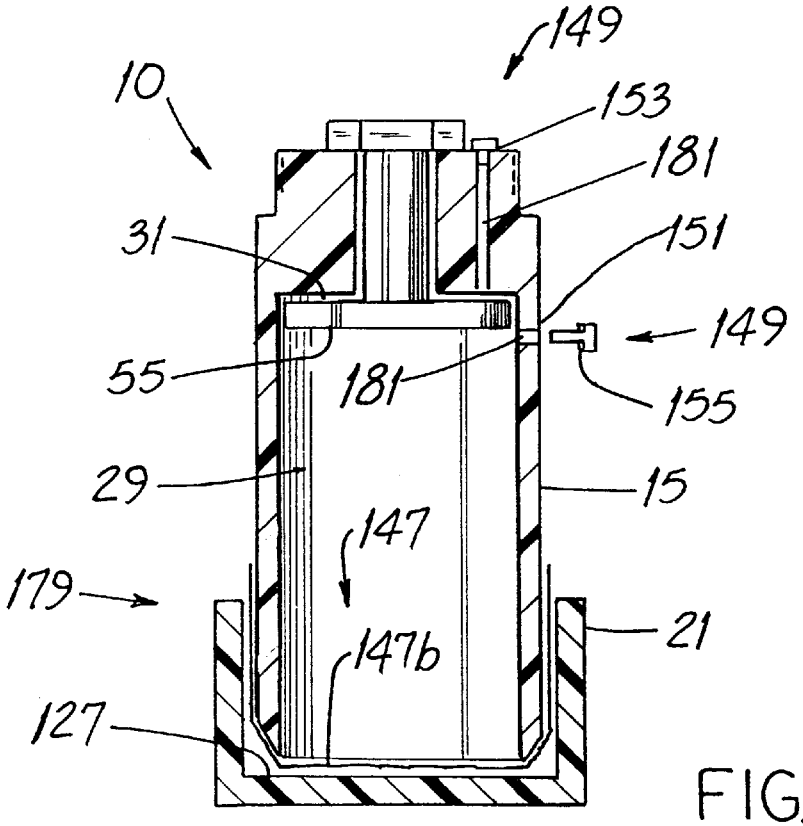
FIG. 21 is a cross-sectional elevation view of still another embodiment of the new sampling tool showing another alternate sealing arrangement.

FIGS. 20 and 21, show other ways to effect a good seal between the cap 21 and barrel 15 and to vent air from the barrel 15 as the sample 25 is being taken. In the arrangements shown in FIGS. 20 and 21, a seal 147 is interposed between the abutment face 127 and the distal end 23. In one, more specific embodiment shown in FIG. 20, the seal 147 is a septum 147*a* having a diameter substantially equal to the diameter of the barrel distal end 23. A suitable septum 147*a* is a disc-shaped pad made of Teflon® or Viton®. In another embodiment shown in FIG. 21, the seal 147 is a flexible sheet 147*b* of, e.g., Teflon® or Viton®, between the cap 21 and the barrel 15.

Referring to FIG. 21, the plunger head 55 is in the barrel cavity 29 and the tool 10 has a releasable vent valve 149 which opens into such cavity 29. With the valve 149 at the location 151, the plunger head 55 is between the vent valve 149 and the distal end while 23 the head 55 is moving toward the cavity terminus 31. With the valve 149 at the location 153, the plunger head 55 is between the vent valve 149 and the distal end 23 for all positions of the head 55 in the cavity 29.

An exemplary embodiment of a vent valve 149 includes a screw 155 threaded into the barrel 15. The screw 155 is loosened while taking a sample 25 and thereafter tightened to seal and prevent migration of air into the cavity 29.

Figure 22:
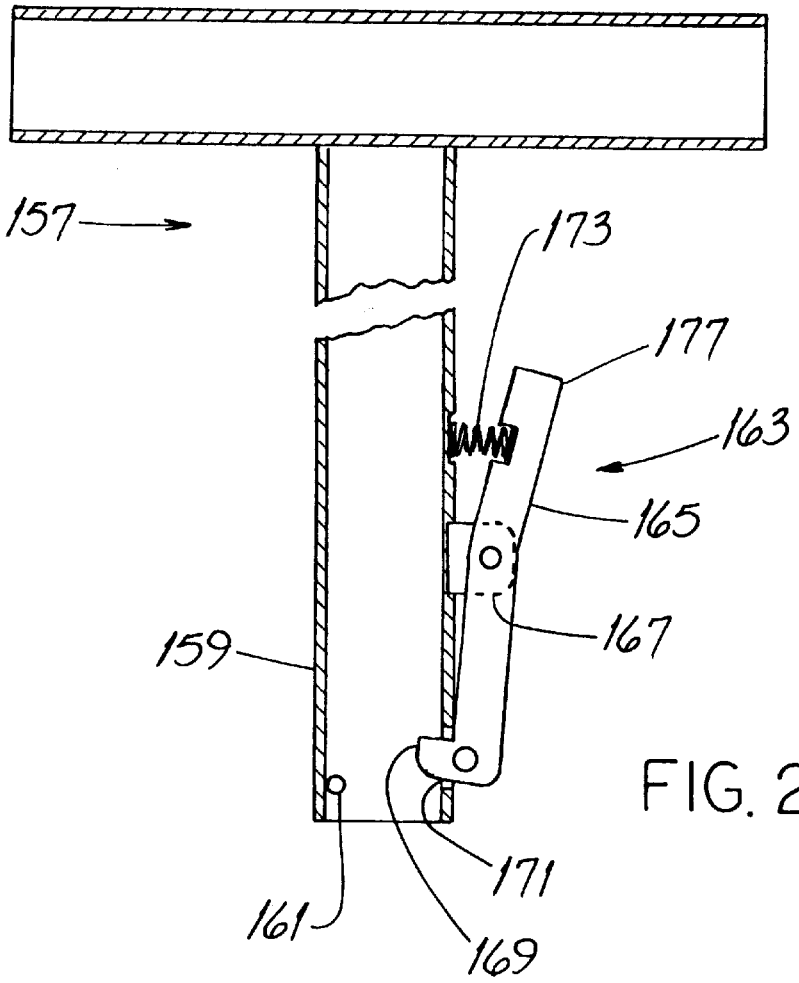
FIG. 22 is a cross-sectional elevation view of an optional tool insertion handle. Parts are broken away and other parts are shown in full representation.

Referring next to FIGS. 2, 3, 4, 5, 9, 12 and 22, it is often helpful during soil sampling to be able to urge the tool barrel 15 into soil 11 from some distance away. A convenient accessory includes a T-shaped elongate insertion handle 157. The barrel 15 has a pair of L-shaped (or reverse L-shaped) channels 65 formed in it and the handle 157 includes an attachment portion 159 having a pair of interior, radially-inwardly-directed pins 161, one of which is shown in FIG. 22. The channels 65 and pins 161 are cooperatively sized and located so that as the handle 157 and the barrel 15 are attached to one another, each pin 161 extends into a respective channel 65.

Figure 5:
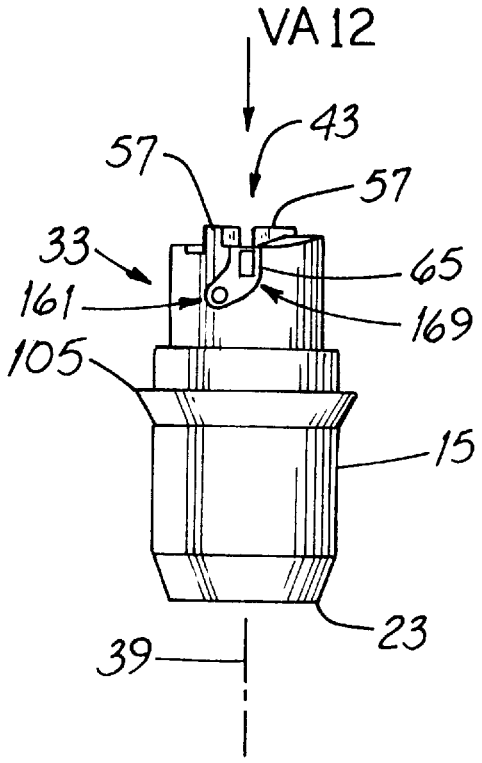
FIG. 5 is an elevation view of the barrel of FIGS. 3 and 4.

The preferred handle 157 also includes a biased latch mechanism 163 having a latch bar 165 pivot-mounted on the support 167. The bar 165 has a tang 169 that extends through an opening 171 in the wall of the portion 159 when the bar 165 is biased by the spring 173 to the depicted position. The pins 161, channels 65, opening 171 and tang 169 are cooperatively positioned so that when the pins 161 are in the channels 65 and the barrel 15 and handle 157 are relatively rotated to bring the pins 161 to the position shown in FIG. 5, thereby locking the barrel 15 to the handle 157, the tang 169 is in registry (both axial and radial registry) with a channel 65 as shown in FIG. 5. When it is desired to release the barrel 15 and the handle 157 from one another, the bar 165 is depressed at the location 177 and the barrel 15 and handle 157 are relatively rotated and then drawn axially apart.

Another aspect of the invention involves a method for collecting a soil sample 25 containing a VOC. The method includes providing a sampling tool 10 including (a) a barrel 15 having a barrel distal end 23, (b) a soil-receiving cavity 29 in the barrel 15, and (c) a cap 21 for closing the end 23. The distal end 23 is pushed into soil 11 so that the cavity 29 is filled with the sample 25. The cap 21 is then urged over the barrel distal end 23 toward a sealing position, thereby expelling air through the air vent passage between the barrel seal surface 121 and the cap relief surface 135. Closure is by positioning the cap 21 at the sealing position 179 shown in FIGS. 18, 20 and 21, thereby occluding the passage.

In more specific aspects of the method, the filling step includes closing the air passage 181 adjacent to the cavity terminus 31. And the positioning step includes placing the O-ring seal 129 against the seal surface 121 or placing the septum 147*a* or the sheet 147*b* against the barrel distal end 23 which, in certain embodiments, forms the seal surface.

At least those parts of the tool 10 which come into contact with possibly-contaminated soil 11 are preferably made of an inert material, i.e., a material which neither leaches out into the sample 25 nor absorbs VOC from the sample 25. A highly preferred material is a pure polyphthalamide plastic containing 50% glass fiber and is made by RTP Company of Winona, Minn., their compound no. 4099X68131 natural or their compound no. 4099X73382 natural. Such material is suitable for injection molding. "Pure" means that the material is free of internal lubricant, heat stabilizer and colorant. Exemplary preferred inert seal materials are Teflon® and Viton®.

Figure 23:
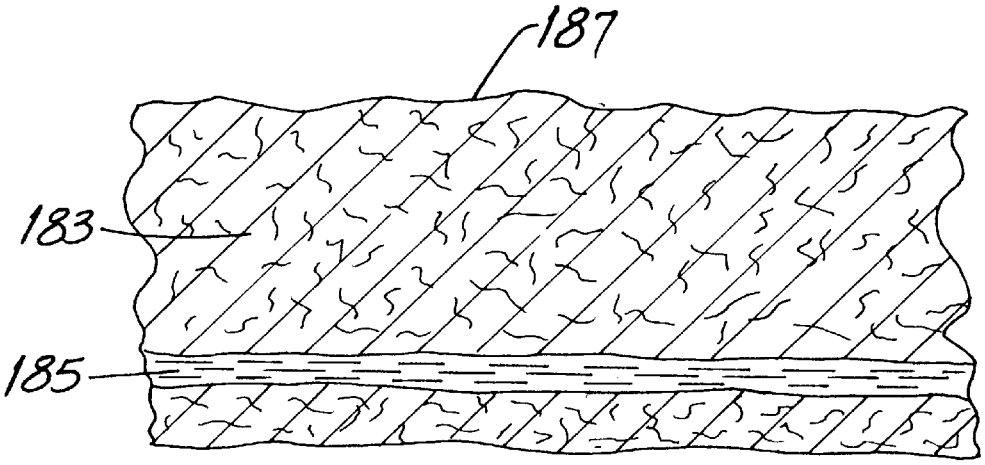
FIG. 23 is a sectional elevation view of those portions of the earth including a water table, soil below the water table and the vadose zone between the water table and the earth's surface.

Referring now to FIG. 23, all embodiments of the tool 10 described herein are specifically configured for sampling soil 11 in the vadose zone 183, i.e., the water-unsaturated soil between the water table 185 and the surface of the earth 187. In the vadose zone 183, soil moisture content may be in the range of 20% to zero or near-zero. A typical moisture content is about 10%. In contradistinction, the mud at the bottom of a lake or ocean is likely to have a moisture content well in excess of 50%.

While the principles of the invention have been shown and described in connection with only a few preferred embodiments, it is to be understood clearly that such embodiments are by way of example and are not limiting.

What is claimed:

1. In a soil-sampling tool extending along a longitudinal axis and including a barrel having (a) a soil-penetrating distal end, and (b) a cap for closing the end, the improvement wherein:

the barrel has a seal surface spaced from the end and having a first lateral dimension;

the barrel has a lead portion between the surface and the end, such lead portion having a second lateral dimension less than the first lateral dimension;

the cap includes an abutment face and a seal spaced from the abutment face by a longitudinal dimension; and the surface is spaced from the end by a distance not greater than the longitudinal dimension;

the lead portion includes a tapered barrel face extending axially away from the end; and the cap includes a tapered cap face extending axially away from the abutment face.

2. The tool of claim 1 wherein:

the barrel face and the cap face engage one another when the abutment face is substantially against the barrel end.

3. The tool of claim 2 wherein:

the barrel includes a mid-surface having a lateral surface dimension;

the seal surface is between the mid-surface and the end;

the cap includes a relief surface having a lateral relief dimension greater than the lateral surface dimension, thereby defining an air vent passage between the mid-surface and the relief surface.

4. The tool of claim 3 wherein:

the longitudinal dimension is a first longitudinal dimension and the barrel includes an exterior deformity spaced from the end by a second longitudinal dimension; and the cap includes a locking member having an interior deformity spaced from the abutment face by the second longitudinal dimension.

5. The tool of claim 4 wherein:

the exterior deformity includes a radially outwardly extending ridge; and the interior deformity includes a groove.

6. The tool of claim 1 wherein:

the longitudinal dimension is a first longitudinal dimension and the barrel includes an exterior deformity spaced from the end by a second longitudinal dimension; and the cap includes a locking member having an interior deformity spaced from the abutment face by the second longitudinal dimension.

7. The tool of claim 6 wherein:

the exterior deformity includes a radially outwardly extending ridge; and the interior deformity includes a groove.

8. The tool of claim 1 in combination with an elongate insertion handle affixed to the barrel and wherein:

the barrel has a pair of channels formed therein;

the handle includes an attachment portion having a pair of pins, each pin extending into a respective channel; and the handle includes a biased latch mechanism extending into a channel.

9. In a soil-sampling tool extending along a longitudinal axis and including a barrel having a cavity and a distal end, a cap closing the end and a soil sample in the cavity, the improvement wherein:

the barrel has a seal surface spaced from the end, a stop shoulder between the seal surface and the end, and a tapered barrel face extending away from the end;

the cap includes a lip against the stop shoulder, a seal against the seal surface and a tapered cap face substantially contacting the barrel face, thereby substantially eliminating an air void between the cap and the barrel.

10. The tool of claim 9 wherein:

the barrel includes an exterior surface deformity;

the cap includes a locking member having an interior surface deformity engaging the exterior surface deformity, thereby securing the cap to the barrel.

11. The tool of claim 9 wherein the cap includes an abutment face substantially against the distal end.

12. The tool of claim 9 in combination with an elongate insertion handle affixed to the barrel and wherein:

the barrel has a pair of channels formed therein;

the handle includes an attachment portion having a pair of pins, each pin extending into a respective channel; and the handle includes a biased latch mechanism extending into a retention slot.

13. A method for collecting a soil sample containing a volatile organic compound including:

providing a sampling tool including (a) a barrel having a barrel distal end and a seal surface spaced from the distal end, (b) a soil-receiving cavity in the barrel, the cavity including a terminus spaced from the barrel distal end and an air passage adjacent to the terminus, and (c) a cap for closing the end, the cap including an O-ring seal;

pushing the distal end into soil;

filling the cavity with the sample;

closing the air passage;

urging the cap over the distal end and toward a sealing position, thereby expelling air through a vent structure; and positioning the cap at the sealing position; and placing the seal against the seal surface, thereby occluding the vent structure.

14. A method for collecting a soil sample containing a volatile organic compound including:

providing a sampling tool configured for hand manipulation and including (a) a barrel having a barrel distal end, (b) a soil-receiving cavity in the barrel, and (c) a cap for closing the end;

hand-pushing the distal end into soil having a moisture content not in excess of about 20%;

filling the cavity with the sample;

urging the cap over the distal end and toward a sealing position, thereby expelling air through a vent structure adjacent to the barrel distal end; and positioning the cap at the sealing position, thereby occluding the vent structure.

15. The method of claim 14, wherein the cap includes an arm extending therefrom, the sampling tool includes a locking structure comprising an exterior deformity on the barrel and an interior deformity on the arm and wherein:

the positioning step includes engaging the deformities with one another, thereby securing the cap to the barrel.

16. The method of claim 14 wherein the cavity has a terminus spaced from the distal end and an air passage adjacent to the terminus and the filling step is concluded by closing the air passage by threading a screw thereinto.

* * * * *

UNITED STATES PATENT AND TRADEMARK OFFICE

CERTIFICATE OF CORRECTION

PATENT NO. : 5,937,953

DATED : August 17,1999

INVENTOR(S) : Nils K. Melberg, Lloyd E. Jacobs, David E. Turriff, Christopher A. Reitmeyer

It is certified that error appears in the above-identified patent and that said Letters Patent is hereby corrected as shown below: On the title page, item [54] and Col. 1, line 2, In the Title, change "FEATURES" to --FEATURE--.

In claim 15, line 4, delete "arm" and insert --cap--.

Signed and Sealed this

Fourteenth Day of March, 2000

*Attest:*

Q. TODD DICKINSON

*Attesting Officer*

*Commissioner of Patents and Trademarks*